United States Patent [19]

Piano

[11] Patent Number: 4,838,448

[45] Date of Patent: Jun. 13, 1989

[54] TAMPER INDICATOR LID

[75] Inventor: Anthony P. Piano, Sparta, N.J.

[73] Assignee: Warner-Lambert Company, Morris Plains, N.J.

[21] Appl. No.: 139,878

[22] Filed: Dec. 30, 1987

[51] Int. Cl.[4] ..... B65D 41/32

[52] U.S. Cl. ..... 220/257

[58] Field of Search ..... 220/257

[56] References Cited

U.S. PATENT DOCUMENTS 3,255,915 6/1966 Scholtz ..... 220/257

3,690,506 9/1972 Kennedy ..... 220/257

4,565,294 1/1986 Smith ..... 220/257 X

*Primary Examiner*—Donald F. Norton

*Attorney, Agent, or Firm*—Henry C. Jeanette; Charles A. Gaglia, Jr.

[57] ABSTRACT

A container for holding articles includes a tamper detectable lid which is integrally attached to the container to overlay a capped opening to the container. Removal of the lid from the container provides evidence of tampering and must, in any event, be accomplished to operably expose the capped opening to the container.

10 Claims, 2 Drawing Sheets

TAMPER INDICATOR LID

BACKGROUND OF THE INVENTION

This invention relates generally to tamper resistant product containers. More specifically, the present invention pertains to tamper indicator closures for covering the openings of product containers. This invention is particularly, but not exclusively, useful in cooperation with a container or package designed to hold edible or ingestible products.

DISCUSSION OF THE PRIOR ART

Various packaging techniques have been disclosed in recent years which are intended to provie evidence of tampering. Unfortunately, these techniques and disclosures have been necessary because of several incidents involving the adulteration or substitution of a package's contents. As should be expected, the particular device and materials used to indicate whether tampering has occurred will depend to a great extent on the nature of the packaging. For example, packaging which is made of a frangible wrapping material, such as the popular "blister" package currently used for pharmaceutical tablets, will necessarily employ means which are quite different from those used with other kinds of containers. Regardless of the type of container, however, the specific intent is to provide some means whereby it can be determined whether tampering has occurred. Typically, indications of tampering are detected by the destruction or partial destruction of the device.

The present invention is primarily concerned with bottle and can type containers which are made of rigid or semi-rigid materials such as a hard plastic or a metal. With such containers, tamper indicators are typically associated with the opening to the container and the cover for the opening. An example of such an indicator is the plastic band which is heat-shrunk onto the area where the cap connects with the bottle neck. Such an indicator, however, can be broken, removed and then relatively easily replaced with another look-alike band after the contents of the container have been disturbed. Another example of a tamper-indicator for a bottle type container is the bottle-in-a-can combination device. With such a device, a normal bottle is completely sealed within a can which is itself a tamper proof container. Thus, any tampering with the outer container provides evidence to warn the consumer of the possibility that the inside bottle may have also suffered tampering. The main difficulty with such a combination stems from the necessity to effectively package the product twice. This double packaging increases costs and causes additional manufacturing steps which are avoidable.

The present invention recognizes that a normal easily accessible bottle or can type container can be provided with means which provide evidence of tampering. More specifically, the present invention recognizes that many problems associated with the manufacture of such containers can be obviated by providing a tamper indicating lid which overlays an underlying capped entrance to the inside of the container.

In light of the above, it is an object of the present invention to provide a container which will give easily identifiable tamper evidence. Another object of the present invention is to provide a container with tamper indicating means that overlays the operable opening to the container. Still another object of the present invention is to provide a container which is relatively easily manufactured. Other objects include providing a tamper indicator article container which is cost effective to manufacture and which is easily used.

SUMMARY OF THE INVENTION

A preferred embodiment of the novel tamper-proof product container includes a receptacle for holding products or articles. An opening or orifice to the receptacle is encircled by a raised rim, and a removable standard or child-resistant cap is provided to cover the orifice for holding products in the receptacle. A lid is integrally joined to the rim to overlay the capped orifice so that the separation or removal of the lid which is necessary to attain access to the capped orifice will also provide evidence of tampering.

The novel features of this invention, as well as the invention itself, both as to its structure and its operation will be best understood from the accompanying drawings, taken in conjunction with the accompanying description, in which similar reference characters refer to similar parts, and in which:

DESCRIPTION OF THE PREFERRED EMBODIMENT

Figure 1:
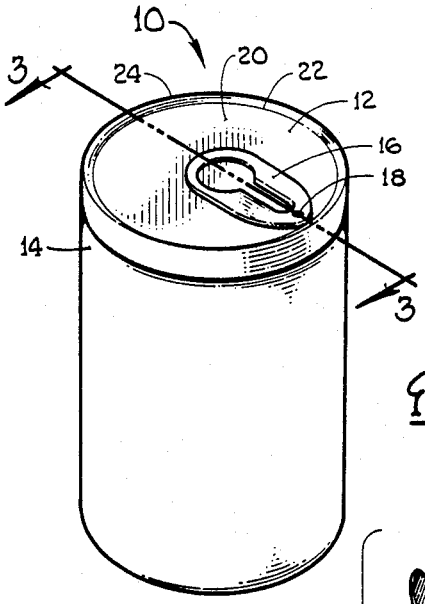
FIG. 1 is a perspective view of the container of the present invention.

Referring initially to FIG. 1, an article container in accordance with the present invention is shown and generally designated 10. As shown, container 10 includes a lid 12 which is attached to a receptacle 14 in which articles can be held. A ring 16 is attached to lid 12 by an attachment 18 well known in the pertinent art, such as a clamp or a keeper pin. It will also be seen that a depressor 20 is formed on ring 16 on one side of attachment 18 for a purpose to be subsequently disclosed. Lid 12 is provided with a score line 22, or weakened area, near its periphery 24. The structure and associated structure thus disclosed for lid 12 is such that a manipulative lifting of ring 16 will cause attachment 18 to act as a fulcrum and move depressor 20 in a manner which will make an initial break in lid 12 at score line 22 and allow separation of lid 12 from receptacle 14 as shown in FIG. 2A.

Figure 2A:
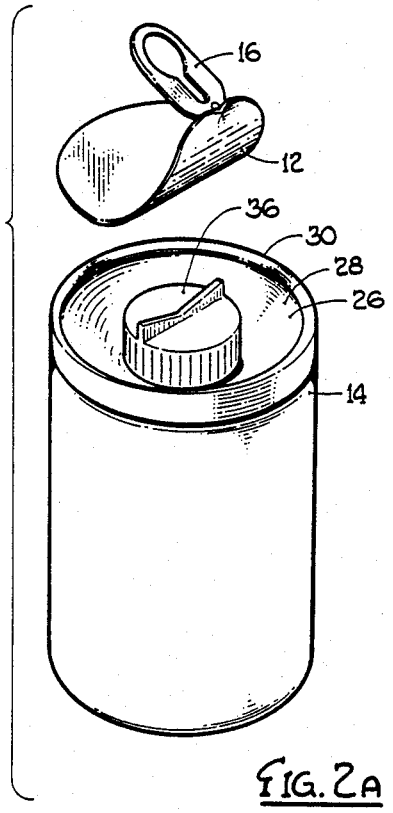
FIGS. 2A and 2B are exploded perspective views which successively show removal of the lid and the cap from the container of the present invention.
Figure 2B:
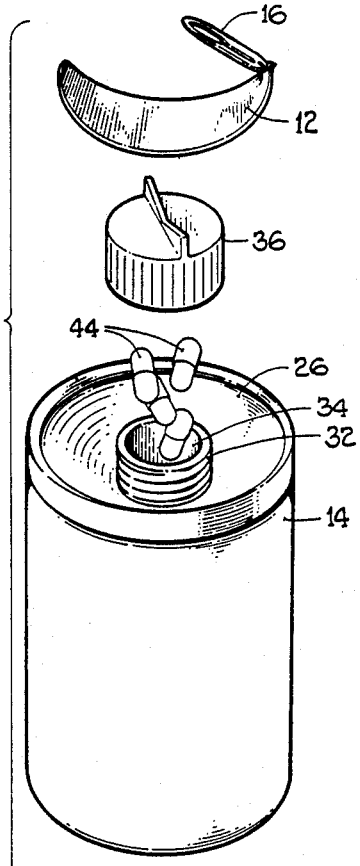

The opening of container 10 will be best seen by reference to FIGS. 2A and 2B. As will be appreciated with reference to FIG. 2A, the separation or removal of lid 12 reveals a still unitary receptacle 14 in which articles can be held. Specifically, this is so in order to require a separate initial operation, i.e. removal of lid 12, before articles can be removed from receptacle 14. This will provide dramatic evidence of any tampering that may have occurred prior to operational use of the article container 10. As will be appreciated from the subsequent disclosure, lid 12 is joined to receptacle 14 in a manner which easily indicates tampering even though lid 12 may not be completely removed. This is so because any breaking of score line 22 will also provide easily identifiable evidence of tampering.

Still referring to FIG. 2A, it will be seen that a layer 26 forms part of receptacle 14. More specifically, layer 26 establishes a recess 28 which rises to present a rim 30. In FIG. 2B, it will be seen that layer 26 includes a threaded neck 32 which surrounds an orifice 34. A cap 36 is provided which is threadably engageable with neck 32 to cover orifice 34. It will be understood by the skilled artisan that a standard cap, as well as any child-resistant or tamper indicating cap, may be used for the purposes of the present invention. Indeed, several examples of each type cap can be easily found in the market place.

Figure 3B:
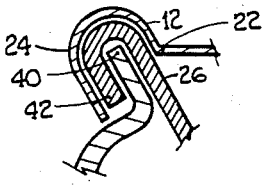
FIG. 3 is a side cross sectional view of the container as seen along the line 3—3 in FIG. 1.
Figure 3A:
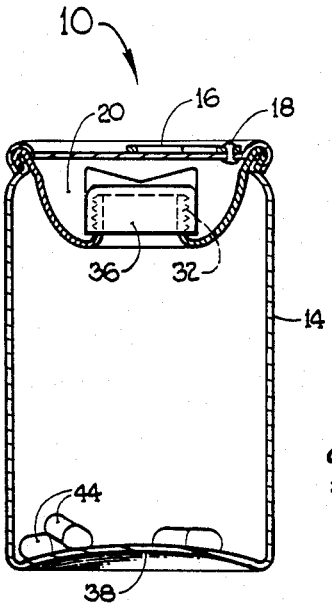

The actual construction of container 10 will perhaps be best understood with reference to FIG. 3. There it can be seen that receptacle 14 is essentially cylindrically shaped with a closed bottom 38 and an open top which defines a lip 40. The edge 42 of layer 26 is crimped or joined to lip 40 of receptacle 14, in any manner well known in the pertinent art, to establish rim 30. Periphery 24 of lid 12 is joined to rim 30 in a like manner. It is to be understood, however, that the joining of periphery 24 to rim 30 and the joining of edge 42 to lip 40 can be accomplished by different methods and need not be done in a set order.

Figure 4A:
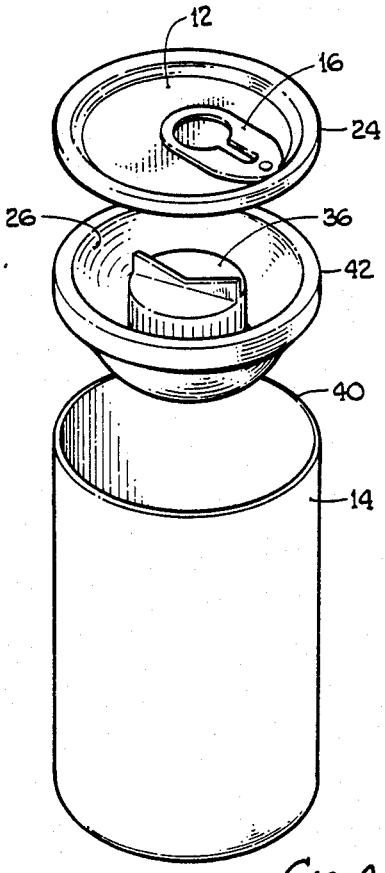
FIGS. 4A and 4B are exploded perspective views which show the cooperative relationships between the major components of the container according to the present invention.
Figure 4B:
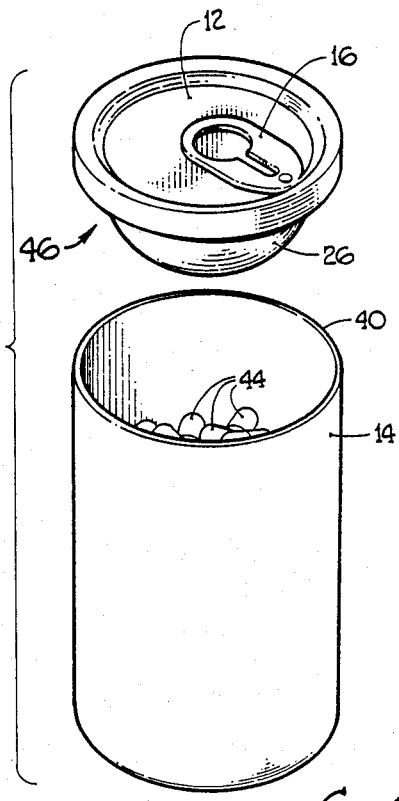

The packaging of articles 44 in container 10 is best appreciated by reference to FIGS. 4A and 4B wherein it is seen that lid 12, with ring 16 attached, is positioned to overlay layer 26 with cap 36 engaged. Specifically, periphery 24 of lid 12 is joined to edge 42 of layer 26 to establish a cover which is generally designated 46, as shown in Figure 4B. Cover 46 is then engageable with lip 40 of receptacle 14 to hold articles 44 therein. The result is a container 10 as substantially shown in FIG. 1.

As intended for the present invention, container 10 is presented as an integral unit. Access to articles 44 being held in receptacle 14 requires either (i) removal of lid 12 for operable access to cap 36, (ii) damage to receptacle 14 or (iii) the prying of cover 46 off of receptacle 14. In either case, container 10 is inalterably changed to show evidence of tampering. The preferred manner of opening container 10 is, of course, to lift ring 16 and break score line 22. Further lifting of ring 16 allows progressive breaking of score line 22 until the line 22 is completely broken and lid 12 can be removed from container 10. This presents cap 36 in a manner which allows its disengagement from layer 26 to permit removal of articles 44 from receptacle 14. A sequential illustration of this cooperation of structure is provided by FIGS. 1, 2A and 2B.

While the particular tamper proof article container as herein shown and disclosed in detail is fully capable of obtaining the objects and providing the advantages herein before stated, it is to be understood that it is merely illustrative of the presently preferred embodiments of the invention and that no limitations are intended to the details of construction or design herein shown other than as defined in the appended claims.

I claim:

1. A tamper indicator cover for an article receptacle which comprises:

a layer having an edge attached to said receptacle and said layer formed with an orifice;

means engageable with said layer to cover said orifice;

a lid having a periphery, said periphery being joined to said edge of said layer; and means attached to said lid for separating said lid from said layer.

2. A cover as recited in claim 1 wherein said cover is integrally attached to said receptacle.

3. A cover as recited in claim 2 wherein said separating means is a ring.

4. A cover as recited in claim 3 wherein said lid is formed with a breakable score line which is positioned on said lid near said periphery of said lid.

5. A cover as recited in claim 4 wherein said engageable means is a cap.

6. A tamper-proof article container comprising:

a receptacle having an orifice and formed with an externally raised portion surrounding said orifice to establish a rim;

means for covering said orifice to hold articles in said container; and a lid having a periphery, said periphery being breakably joined to said rim to overlay said covering means.

7. A container as recited in claim 6 wherein said covering means is a cap.

8. A container as recited in claim 7 wherein said lid is formed with a score line at said periphery of said lid to facilitate separation of said lid from said container.

9. A container as recited in claim 8 further comprising a ring attached to said lid, said ring being manipulable to separate said lid from said container.

10. A tamper-proof article container comprising:

a receptacle having an orifice and formed with an externally raised portion surrounding said orifice to establish a rim;

a layer establishing a recess portion rising from said orifice to said externally raised portion; means for covering said orifice to hold articles in said container; and a lid having a periphery, said periphery being breakably joined to said rim to overlay said covering means.

* * * * *